US010830048B2

(12) United States Patent
Shaughnessy

(10) Patent No.: US 10,830,048 B2
(45) Date of Patent: Nov. 10, 2020

(54) GAS TURBINE ROTOR DISK HAVING SCALLOP SHIELD FEATURE

(71) Applicant: UNITED TECHNOLOGIES CORPORATION, Farmington, CT (US)

(72) Inventor: Kyle F. Shaughnessy, Manchester, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 116 days.

(21) Appl. No.: 16/265,399

(22) Filed: Feb. 1, 2019

(65) Prior Publication Data

US 2020/0248711 A1 Aug. 6, 2020

(51) Int. Cl.

| | |
|---|---|
| ***F01D 5/06*** | (2006.01) |
| ***F01D 5/22*** | (2006.01) |
| ***F04D 29/32*** | (2006.01) |
| *F01D 5/30* | (2006.01) |

(52) U.S. Cl.

CPC ..... *F01D 5/06* (2013.01); *F01D 5/225* (2013.01); *F04D 29/329* (2013.01); *F01D 5/3007* (2013.01)

(58) Field of Classification Search

None

See application file for complete search history.

(56) References Cited

U.S. PATENT DOCUMENTS

| | | | | |
|---|---|---|---|---|
| 3,262,676 | A * | 7/1966 | Huebner, Jr. | F01D 5/30 416/244 R |
| 3,294,366 | A * | 12/1966 | Coplin | F01D 5/28 416/220 R |
| 8,246,309 | B2 | 8/2012 | Snecma | |
| 8,328,519 | B2 * | 12/2012 | Denis | F01D 5/027 416/144 |
| 8,342,804 | B2 * | 1/2013 | Pronovost | F01D 5/027 416/144 |
| 2017/0211398 | A1 | 7/2017 | Quinn et al. | |

FOREIGN PATENT DOCUMENTS

| | | | | |
|---|---|---|---|---|
| GB | 1224759 | A * | 3/1971 | F01D 5/3061 |

* cited by examiner

*Primary Examiner* — Brian P Wolcott
*Assistant Examiner* — Jason G Davis
(74) *Attorney, Agent, or Firm* — Snell & Wilmer L.L.P.

(57) ABSTRACT

A rotor disk for a gas turbine engine is disclosed. In various embodiments, the rotor disk includes a rim portion disposed about a central axis; a blade post disposed proximate the rim portion, the blade post having a first branch and a second branch; and a first scallop disposed within the rim portion, between and radially inward of the first branch and the second branch.

15 Claims, 4 Drawing Sheets

GAS TURBINE ROTOR DISK HAVING SCALLOP SHIELD FEATURE

GOVERNMENT LICENSE RIGHTS

This invention was made with Government support awarded by the United States. The Government has certain rights in this invention.

FIELD

The present disclosure relates to gas turbine engines and, more particularly, to rotors and rotor disks used in the compressor and turbine sections of gas turbine engines.

BACKGROUND

Gas turbine engines, such as those used to power modern commercial and military aircraft, typically include a fan section, a compressor section, a combustor section and a turbine section. During operation, air is pressurized in the compressor section and mixed with fuel and burned in the combustor section to generate hot combustion gases. The hot combustion gases are then communicated through the turbine section, which extracts energy from the gases to power the compressor section, the fan section and various other loads occurring within or proximate the gas turbine engine.

The compressor and turbine sections of gas turbine engines often comprise a plurality of rotor assemblies. In some gas turbine engines, various portions of the rotor assemblies are exposed to significant temperatures. For example, in turbine sections, the resultant gases from the combustion process expose the rotor disks and, particularly, the rim portions of the rotor disks, to highly elevated temperatures. Combined with repeated acceleration and deceleration associated with normal operation, the rotor disks may experience low cycle fatigue or thermal mechanical fatigue, particularly at the forward or aft edges of the blade slots.

SUMMARY

A rotor disk for a gas turbine engine is disclosed. In various embodiments, the rotor disk includes a rim portion disposed about a central axis; a blade post disposed proximate the rim portion, the blade post having a first branch and a second branch; and a first scallop disposed within the rim portion, between and radially inward of the first branch and the second branch.

In various embodiments, the first scallop defines a cutout portion having a circumferential length, a radial length and an axial depth. In various embodiments, the rim portion defines a forward face and an aft face and the first scallop is disposed within at least one of the forward face and the aft face. In various embodiments, the first scallop defines a surface intersection where the cutout portion intersects the at least one of the forward face and the aft face. In various embodiments, the surface intersection defines one of an elliptical shape, a circular shape or a racetrack shape. In various embodiments, the surface intersection defines a plane that is perpendicular to the central axis.

In various embodiments, the blade post is positioned between a first disk live and a second disk live and the first disk live and the second disk live define a disk live circumferential arc and a disk live circumferential length. In various embodiments, the first scallop defines a cutout portion having a circumferential length and a radial center.

In various embodiments, the circumferential length is within about thirty percent to about fifty percent of the disk live circumferential length. In various embodiments, the cutout portion defines an axial depth that is within about five percent to about ten percent of the disk live circumferential length.

In various embodiments, the rim portion defines a forward face and an aft face, the first scallop is disposed within at least one of the forward face and the aft face, the first scallop defines a surface intersection where the cutout portion intersects the at least one of the forward face and the aft face, and the surface intersection defines one of an elliptical shape, a circular shape or a racetrack shape. In various embodiments, the surface intersection defines a plane that is perpendicular to the central axis. In various embodiments, the radial center is positioned on the disk live circumferential arc. In various embodiments, the first scallop is disposed within the forward face and a second scallop is disposed within the aft face.

A rotor assembly for a gas turbine engine is disclosed. In various embodiments, the rotor assembly includes a rim disk disposed about a central axis, the rim disk including a rim portion disposed about the central axis; a first blade post disposed proximate the rim portion, the first blade post having a first branch pair; a second blade post disposed proximate the rim portion, the second blade post having a second branch pair and spaced circumferentially from the first blade post; a first scallop disposed within the rim portion, between and radially inward of the first branch pair; and a second scallop disposed with the rim portion, between and radially inward of the second branch pair.

In various embodiments, the first blade post is positioned between a first disk live and a second disk live, the second blade post is positioned between the second disk live and a third disk live, where the first disk live, the second disk live and the third disk live define a disk live circumferential arc and a disk live circumferential length.

In various embodiments, the first scallop defines a first cutout portion having a first circumferential length and a first radial center and the second scallop defines a second cutout portion having a second circumferential length and a second radial center and both the first circumferential length and the second circumferential length are within about thirty percent to about fifty percent of the disk live circumferential length. In various embodiments, the first cutout portion defines a first axial depth that is within about five percent to about ten percent of the disk live circumferential length and the second cutout portion defines a second axial depth that is within about five percent to about ten percent of the disk live circumferential length.

In various embodiments, the rim portion defines a forward face and an aft face, the first scallop is disposed within at least one of the forward face and the aft face, the first scallop defines a surface intersection where the first cutout portion intersects the at least one of the forward face and the aft face and the surface intersection defines one of an elliptical shape, a circular shape or a racetrack shape.

A gas turbine engine is disclosed. In various embodiments, the gas turbine engine includes a compressor section having a compressor rotor assembly; a combustor section; and a turbine section having a turbine rotor assembly, wherein at least one of the compressor rotor assembly and the turbine rotor assembly includes a rim disk disposed about a central axis, the rim disk including rim portion; a blade post disposed proximate the rim portion, the blade post having a first branch and a second branch; and a first scallop disposed within the rim portion, between and radially inward of the first branch and the second branch.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1A:
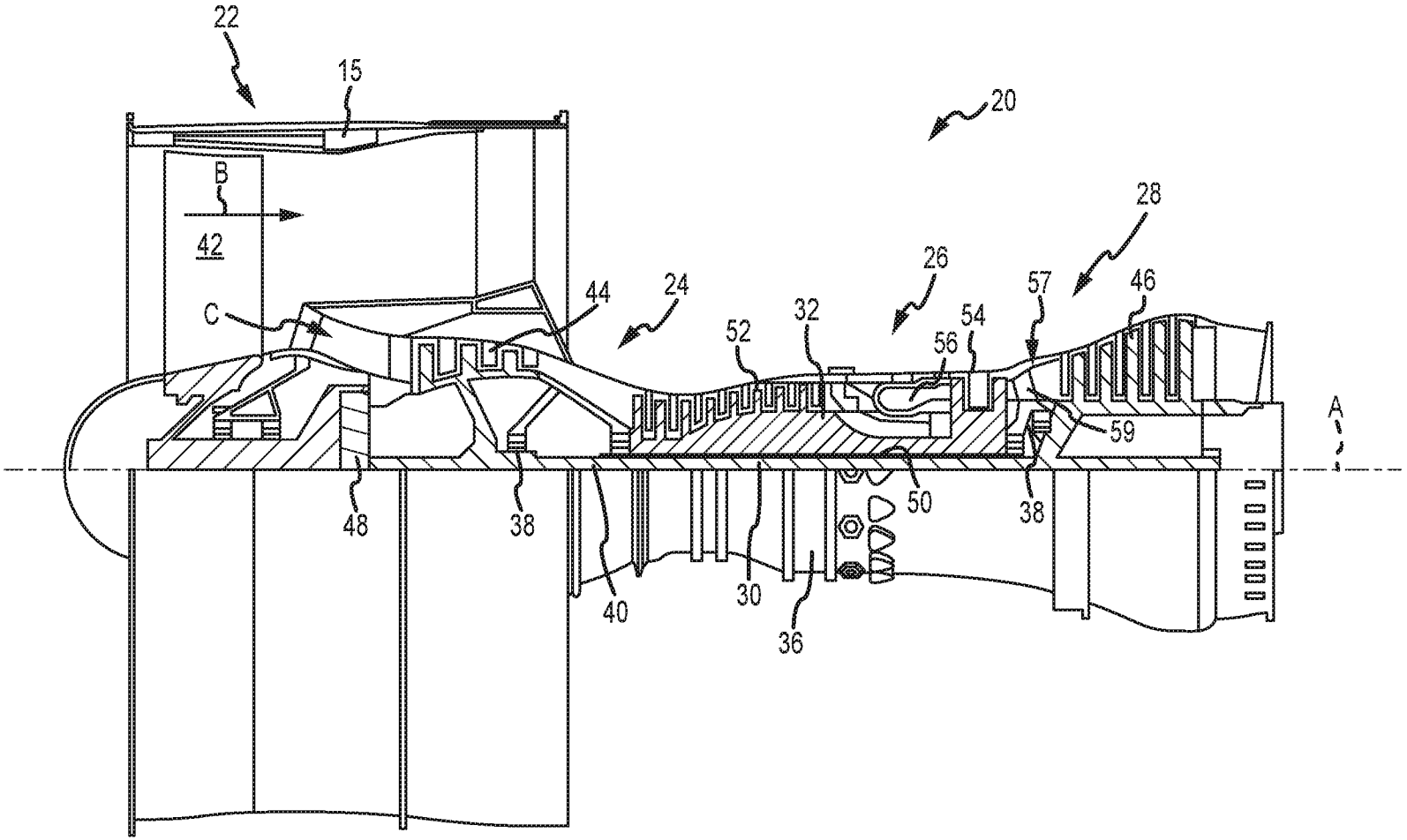
FIG. 1A is a schematic view of a gas turbine engine, in accordance with various embodiments.

Referring now to the drawings, FIG. 1A schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, while the compressor section 24 drives air along a core or primary flow path C for compression and communication into the combustor section 26 and then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems at various locations may alternatively or additionally be provided and the location of the several bearing systems 38 may be varied as appropriate to the application. The low speed spool 30 generally includes an inner shaft 40 that interconnects a fan 42, a low pressure compressor 44 and a low pressure turbine 46. The inner shaft 40 is connected to the fan 42 through a speed change mechanism, which in this gas turbine engine 20 is illustrated as a fan drive gear system 48 configured to drive the fan 42 at a lower speed than the low speed spool 30. The high speed spool 32 includes an outer shaft 50 that interconnects a high pressure compressor 52 and a high pressure turbine 54. A combustor 56 is arranged in the gas turbine engine 20 between the high pressure compressor 52 and the high pressure turbine 54. A mid-turbine frame 57 of the engine static structure 36 is arranged generally between the high pressure turbine 54 and the low pressure turbine 46 and may include airfoils 59 in the core flow path C for guiding the flow into the low pressure turbine 46. The mid-turbine frame 57 further supports the several bearing systems 38 in the turbine section 28. The inner shaft 40 and the outer shaft 50 are concentric and rotate via the several bearing systems 38 about the engine central longitudinal axis A, which is collinear with longitudinal axes of the inner shaft 40 and the outer shaft 50.

The air in the core flow path C is compressed by the low pressure compressor 44 and then the high pressure compressor 52, mixed and burned with fuel in the combustor 56, and then expanded over the high pressure turbine 54 and low pressure turbine 46. The low pressure turbine 46 and the high pressure turbine 54 rotationally drive the respective low speed spool 30 and the high speed spool 32 in response to the expansion. It will be appreciated that each of the positions of the fan section 22, the compressor section 24, the combustor section 26, the turbine section 28, and the fan drive gear system 48 may be varied. For example, the fan drive gear system 48 may be located aft of the combustor section 26 or even aft of the turbine section 28, and the fan section 22 may be positioned forward or aft of the location of the fan drive gear system 48.

Figure 1B:
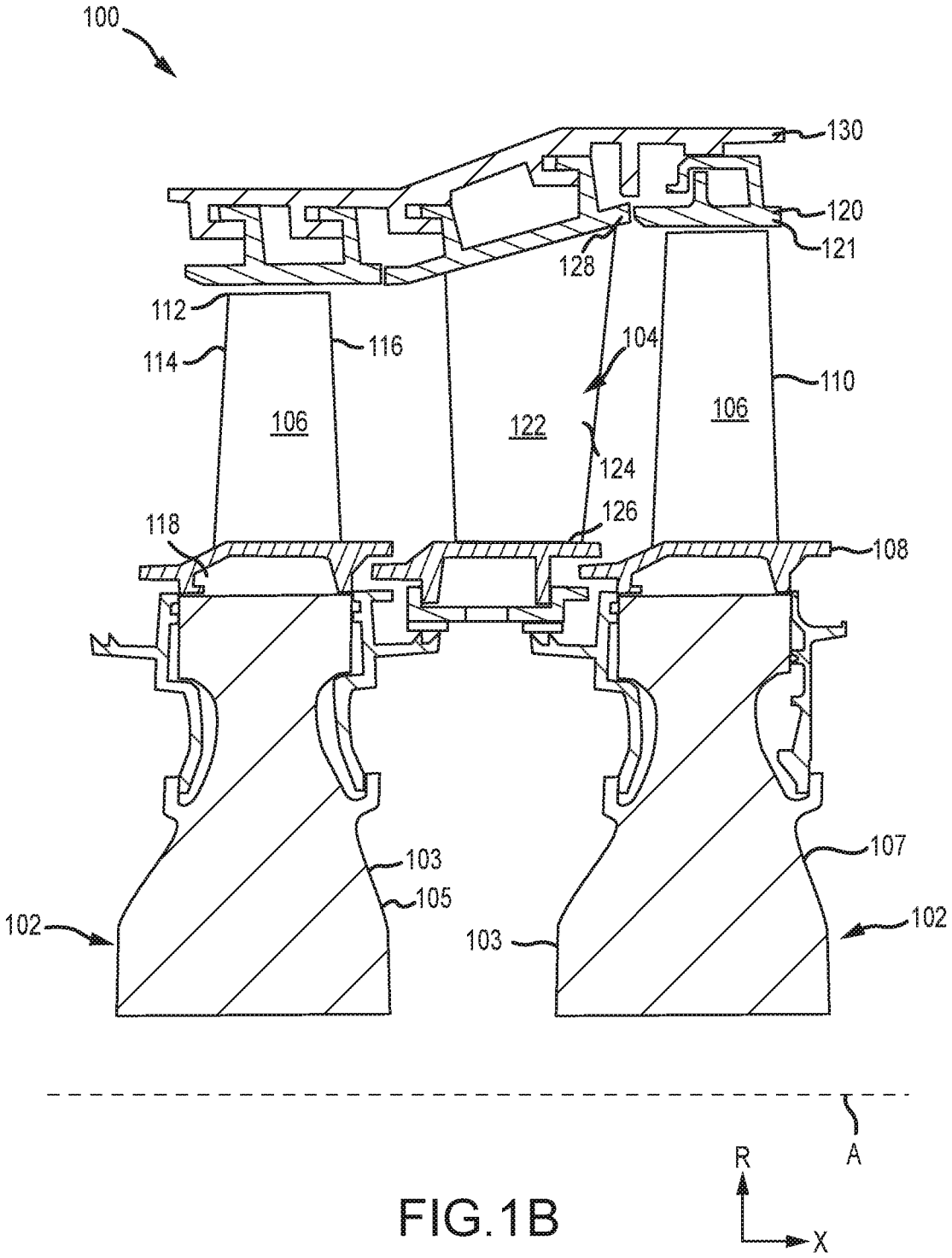
FIG. 1B is a schematic side view of a rotor and vane assembly of a turbine section of a gas turbine engine, in accordance with various embodiments.

Referring now to FIG. 1B, selected portions of a turbine section 100 of a gas turbine engine, such as, for example, the high pressure turbine 54 within the turbine section 28 described above with reference to FIG. 1A, are illustrated. The turbine section 100 includes alternating rows of rotor assemblies 102 and stator assemblies 104. Each of the rotor assemblies 102 carries one or more rotor blades 106 for rotation about a central longitudinal axis A. Each of the rotor blades 106 includes a rotor platform 108 and an airfoil 110 extending in a radial direction R from the rotor platform 108 to a rotor tip 112. The airfoil 110 generally extends in a chord-wise direction X between a leading edge 114 and a trailing edge 116. A root section 118 of each of the rotor blades 106 is mounted to a rotor disk 103, which may be either an upstream rotor disk 105 or a downstream rotor disk 107. A blade outer air seal (BOAS) 120 is disposed radially outward of the rotor tip 112 of the airfoil 110. The BOAS 120 includes a platform 121 that provides a seal to prevent hot gases from leaking outside the core airflow path C (see FIG. 1A).

Each of the stator assemblies 104 includes one or more vanes 122 positioned along the central longitudinal axis A and adjacent to one or more rotor blades 106. Each of the vanes 122 includes an airfoil 124 extending between an inner vane platform 126 and an outer vane platform 128 (or shroud). The stator assemblies 104 are connected to an engine casing structure 130. The BOAS 120 and the stator assemblies 104 may be disposed radially inward of the engine casing structure 130. In various embodiments, one or both of the BOAS 120 and the stator assemblies 104 may include full annular platforms or they may be segmented and include feather seals between segments to help prevent leakage of cooling fluid between the segments. In various embodiments, one or more of the vanes 122 may be configured to rotate about an axis extending between the inner vane platform 126 and the outer vane platform 128.

Figure 2A:
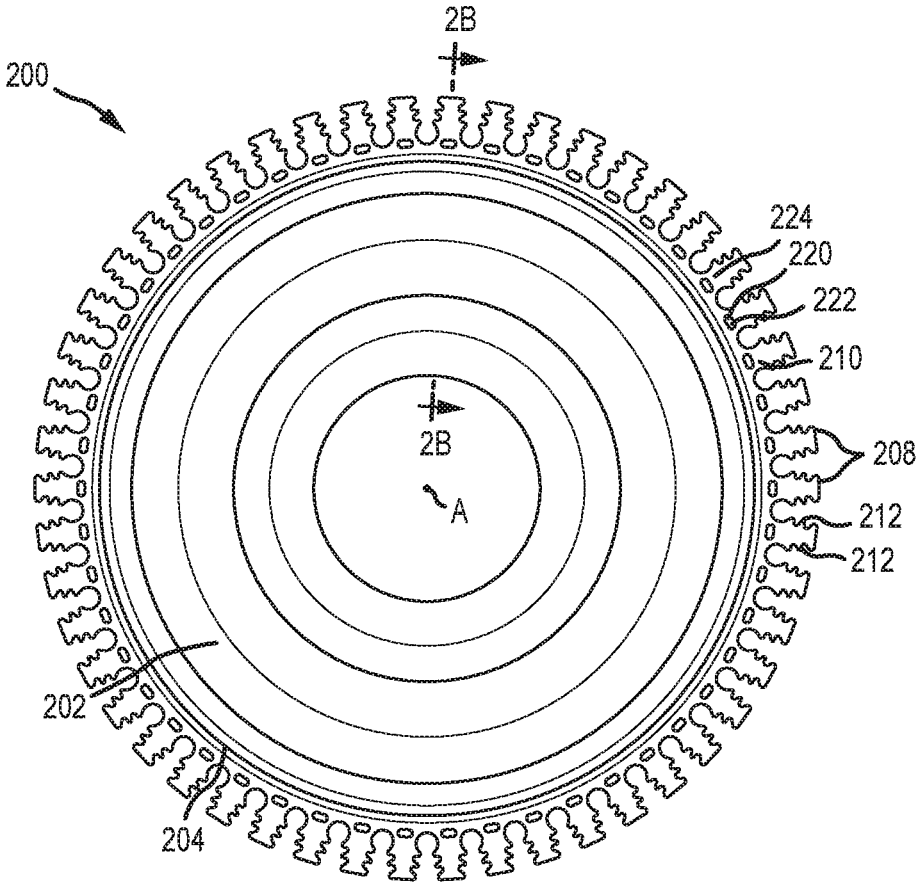
FIGS. 2A and 2B a schematic axial and cross sectional views of a rotor disk, in accordance with various embodiments.
Figure 2B:
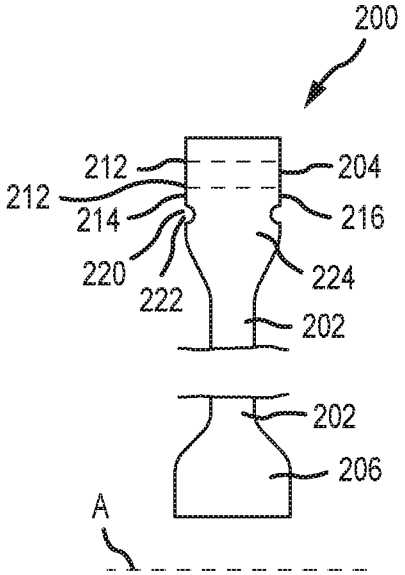

Referring now to FIGS. 2A and 2B, a rotor disk 200 is illustrated. The rotor disk 200 is similar either of the upstream rotor disk 105 or the downstream rotor disk 107 described above with reference to FIG. 1B. More generally, the rotor disk 200 may be included within one or more of the rotor assemblies comprising the compressor section 24 or the turbine section 28 described above with reference to FIG. 1A. In various embodiments, the rotor disk 200 includes a web portion 202, a rim portion 204 and a bore portion 206. A plurality of blade posts 208 extend radially from the rim portion 204 and, in various embodiments, may include a base portion 210 that may be considered to merge into the rim portion 204. Each of the plurality of blade posts 208 also includes one or more branch elements 212, each of which extends in a generally circumferential direction from a respective one of the plurality of blade posts 208. The one or more branch elements 212, positioned on respective ones of the plurality of blade posts 208, are sized and configured to secure corresponding attachment sections of individual rotor blades. The rim portion 204 may include a forward face 214 and an aft face 216. The forward face 214 and the aft face 216 may, in various embodiments, be generally perpendicular to a central axis A. In various embodiments, a scallop 220 (aka a "shield feature"), which may generally be defined by or comprise a cutout portion 222, may be positioned proximate a base portion 224 of one or more of the plurality of blade posts 208. The scallop 220 may be positioned on one or both of the forward face 214 and the aft face 216 of the rim portion 204.

Figure 3A:
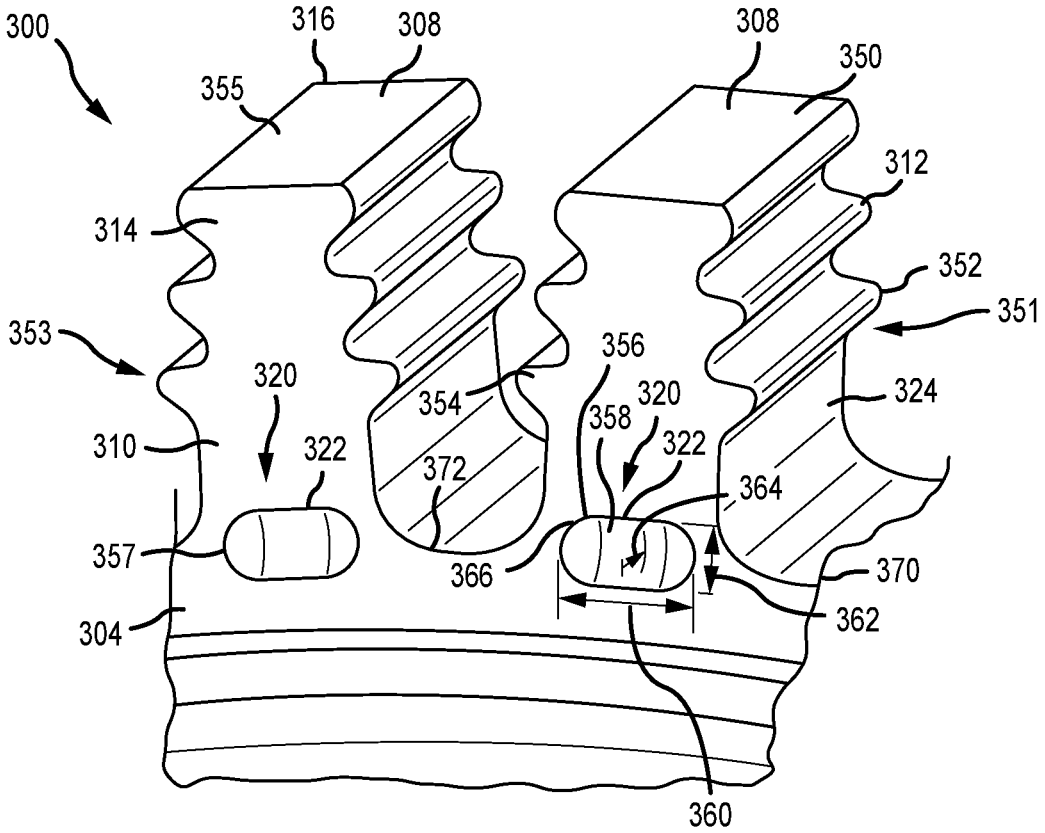
FIGS. 3A and 3B are schematic views of rim sections of a rotor disk, in accordance with various embodiments.
Figure 3B:
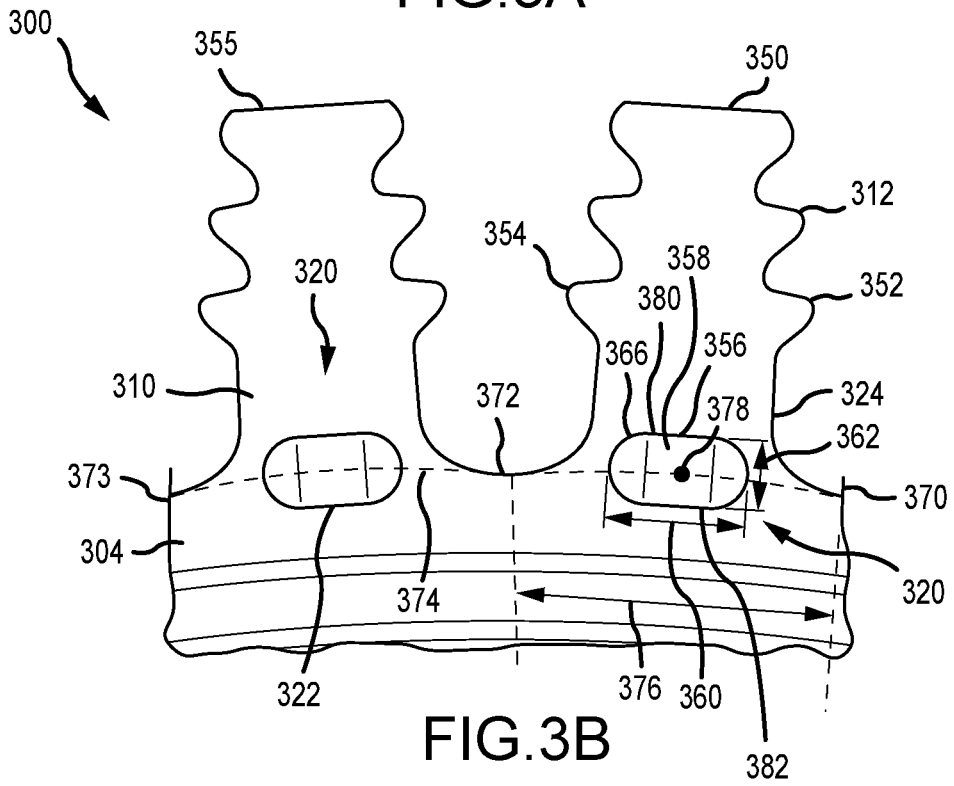

Referring now to FIGS. 3A and 3B, schematic views of a portion of a rim section of a rotor disk 300, such as, for example, the rotor disk 200 described above with reference to FIGS. 2A and 2B. In various embodiments, the rotor disk 300 includes a rim portion 304. A plurality of blade posts 308 extend radially from the rim portion 304 and, in various embodiments, may include a base portion 310 that may be considered to merge into the rim portion 304. Each of the plurality of blade posts 308 also includes one or more branch elements 312, each of which extends in a generally circumferential direction from a respective one of the plurality of blade posts 308. The one or more branch elements 312, positioned on respective ones of the plurality of blade posts 308, are sized and configured to secure corresponding attachment sections of individual rotor blades. The rim portion 304 may include a forward face 314 and an aft face 316. The forward face 314 and the aft face 316 may, in various embodiments, be generally perpendicular to a central axis A, although the faces may also define curved surfaces—e.g., in order to accommodate a rim portion 304 having an axial dimension that is greater than the corresponding axial dimensions of the plurality of blade posts 308. In various embodiments, a scallop 320, which may generally be defined by or comprise a cutout portion 322, may be positioned proximate a base portion 324 of one or more of the plurality of blade posts 308. The scallop 320 may be positioned on one or both of the forward face 314 and the aft face 316 of the rim portion 304.

Still referring to FIGS. 3A and 3B, a first blade post 350 is disposed proximate the rim portion 304. The first blade post includes a first branch 352 and a second branch 354. Together, the first branch 352 and the second branch 354 may be referred to as a branch pair, such as, for example, a first branch pair 351 associated with the first blade post 350 or a second branch pair 353 associated with a second blade post 355. A first scallop 356 is disposed within the rim portion 304, between and radially inward of the first branch 352 and the second branch 354. A second scallop 357 may likewise be disposed within the rim portion proximate the second blade post 355. In various embodiments, the first scallop 356 defines a cutout portion 358 having a circumferential length 360, a radial length 362 and an axial depth 364. In various embodiments, the first scallop 356 defines a surface intersection 366 where the cutout portion 358 intersects the forward face 314. In various embodiments, the surface intersection 366 defines an elliptical shape, a circular shape or a racetrack shape (as illustrated in FIGS. 3A and 3B). In various embodiments, other shapes are contemplated, such as, for example, square shapes, rectangular shapes or general polygonal shapes.

In various embodiments, the first blade post 350 is positioned between a first disk live 370 and a second disk live 372. The first disk live 370 and the second disk live 372 define a disk live circumferential arc 374 and a disk live circumferential length 376. Generally, a disk live, such as, for example, the first disk live 370 and the second disk live 372, defines a radially inner section of the surface of the rim portion 304 extending axially between adjacent pairs of blade posts. The disk live regions may often be subject to relatively high stress concentrations, which may be alleviated through the presence, shape, size and location of the scallops. The second blade post 355 may similarly be positioned between the second disk live 372 and a third disk live 373.

For example, in various embodiments, the first scallop 356 defines the cutout portion 358 as having the circumferential length 360 and a radial center 378 (the radial center 378 being defined as a midpoint between an outer radial surface 380 and an inner radial surface 382). In various embodiments, the circumferential length 360 is within about thirty percent (30%) to about fifty percent (50%) of the disk live circumferential length 376. In various embodiments, the cutout portion 358 defines the axial depth 364 as being within about five percent (5%) to about ten percent (10%) of the disk live circumferential length 376. In various embodiments, the radial center 378 is positioned on the disk live circumferential arc 374.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed:

1. A rotor disk for a gas turbine engine, comprising:

a rim portion disposed about a central axis;

a blade post disposed proximate the rim portion, the blade post having a first branch and a second branch; and a first scallop disposed within the rim portion, between and radially inward of the first branch and the second branch, wherein the blade post is positioned between a first disk live and a second disk live and wherein the first disk live and the second disk live define a disk live circumferential arc and a disk live circumferential length and wherein the first scallop defines a cutout portion having a circumferential length and a radial center.

2. The rotor disk of claim 1, wherein the rim portion defines a forward face and an aft face and wherein the first scallop is disposed within at least one of the forward face and the aft face.

3. The rotor disk of claim 2, wherein the first scallop defines a surface intersection where the cutout portion intersects the at least one of the forward face and the aft face.

4. The rotor disk of claim 3, wherein the surface intersection defines one of an elliptical shape, a circular shape or a racetrack shape.

5. The rotor disk of claim 4, wherein the surface intersection defines a plane that is perpendicular to the central axis.

6. The rotor disk of claim 1, wherein the circumferential length is within thirty percent to fifty percent of the disk live circumferential length.

7. The rotor disk of claim 6, wherein the cutout portion defines an axial depth that is within five percent to ten percent of the disk live circumferential length.

8. The rotor disk of claim 7, wherein the rim portion defines a forward face and an aft face, wherein the first scallop is disposed within at least one of the forward face and the aft face, wherein the first scallop defines a surface intersection where the cutout portion intersects the at least one of the forward face and the aft face and wherein the surface intersection defines one of an elliptical shape, a circular shape or a racetrack shape.

9. The rotor disk of claim 8, wherein the surface intersection defines a plane that is perpendicular to the central axis.

10. The rotor disk of claim 8, wherein the radial center is positioned on the disk live circumferential arc.

11. The rotor disk of claim 1, wherein the rim portion defines a forward face and an aft face and wherein the first scallop is disposed within the forward face and a second scallop is disposed within the aft face.

12. A rotor assembly for a gas turbine engine, comprising:

a rim disk disposed about a central axis, the rim disk including a rim portion disposed about the central axis;

a first blade post disposed proximate the rim portion, the first blade post having a first branch pair;

a second blade post disposed proximate the rim portion, the second blade post having a second branch pair and spaced circumferentially from the first blade post;

a first scallop disposed within the rim portion, between and radially inward of the first branch pair; and a second scallop disposed with the rim portion, between and radially inward of the second branch pair, wherein the first blade post is positioned between a first disk live and a second disk live, the second blade post is positioned between the second disk live and a third disk live, and wherein the first disk live, the second disk live and the third disk live define a disk live circumferential arc and a disk live circumferential length and wherein the first scallop defines a first cutout portion having a first circumferential length and a first radial center and the second scallop defines a second cutout portion having a second circumferential length and a second radial center and wherein both the first circumferential length and the second circumferential length are within thirty percent to fifty percent of the disk live circumferential length.

13. The rotor assembly of claim 12, wherein the first cutout portion defines a first axial depth that is within five percent to ten percent of the disk live circumferential length and the second cutout portion defines a second axial depth that is within five percent to ten percent of the disk live circumferential length.

14. The rotor assembly of claim 13, wherein the rim portion defines a forward face and an aft face, wherein the first scallop is disposed within at least one of the forward face and the aft face, wherein the first scallop defines a surface intersection where the first cutout portion intersects the at least one of the forward face and the aft face and wherein the surface intersection defines one of an elliptical shape, a circular shape or a racetrack shape.

15. A gas turbine engine, comprising:

a compressor section having a compressor rotor assembly;

a combustor section; and a turbine section having a turbine rotor assembly, wherein at least one of the compressor rotor assembly and the turbine rotor assembly includes a rim disk disposed about a central axis, the rim disk including a rim portion;

a blade post disposed proximate the rim portion, the blade post having a first branch and a second branch; and a first scallop disposed within the rim portion, between and radially inward of the first branch and the second branch, wherein the first scallop defines a cutout portion having a circumferential length, a radial length and an axial depth, wherein the rim portion defines a forward face and an aft face and wherein the first scallop is disposed within at least one of the forward face and the aft face, wherein the first scallop defines a surface intersection where the cutout portion intersects the at least one of the forward face and the aft face and wherein the surface intersection defines one of an elliptical shape, a circular shape or a racetrack shape.

* * * * *